US006536539B2

(12) United States Patent
Merecka et al.

(10) Patent No.: US 6,536,539 B2
(45) Date of Patent: Mar. 25, 2003

(54) SHALLOW DEPTH, COILED TUBING HORIZONTAL DRILLING SYSTEM

(75) Inventors: Jeff Merecka, Cypress, TX (US); David Camp, Cypress, TX (US)

(73) Assignee: S & S Trust, Commerce City, CO (US)

( * ) Notice: Subject to any disclaimer, the term of this patent is extended or adjusted under 35 U.S.C. 154(b) by 0 days.

(21) Appl. No.: 09/896,025

(22) Filed: Jun. 29, 2001

(65) Prior Publication Data

US 2002/0000332 A1 Jan. 3, 2002

Related U.S. Application Data

(60) Provisional application No. 60/215,534, filed on Jun. 30, 2000, provisional application No. 60/233,358, filed on Sep. 18, 2000, and provisional application No. 60/258,119, filed on Dec. 22, 2000.

(51) Int. Cl.[7] ..... E21B 7/04

(52) U.S. Cl. ..... 175/62; 175/73; 175/203; 405/154.1

(58) Field of Search ..... 175/73, 162, 104, 175/92, 202, 203, 62; 166/77.1, 77.3; 405/154.1, 174

(56) References Cited

U.S. PATENT DOCUMENTS

| | | | | |
|---|---|---|---|---|
| 4,361,192 A | | 11/1982 | Trowsdale | 175/45 |
| 4,379,493 A | | 4/1983 | Thibodeaux | 175/61 |
| 4,399,877 A | | 8/1983 | Jackson et al. | 175/45 |
| 4,463,814 A | | 8/1984 | Horstmeyer et al. | 175/45 |
| 4,697,638 A | | 10/1987 | Knight | 166/65.1 |
| 4,789,032 A | | 12/1988 | Rehm et al. | 175/45 |
| 4,828,053 A | | 5/1989 | Maurer et al. | 175/75 |
| 4,854,397 A | | 8/1989 | Warren et al. | 175/26 |
| 4,858,705 A | | 8/1989 | Thiery | 175/73 |
| 4,884,643 A | | 12/1989 | Wawrzynowski et al. | 175/74 |
| 4,940,095 A | | 7/1990 | Newman | 166/378 |
| 5,215,151 A | | 6/1993 | Smith | 175/45 |
| 5,311,952 A | | 5/1994 | Eddison et al. | 175/61 |
| 5,575,332 A | * | 11/1996 | Wasterval, Jr. | 166/77.1 |
| 5,947,213 A | * | 9/1999 | Angle et al. | 166/250.01 |
| RE36,556 E | | 2/2000 | Smith et al. | 175/45 |

OTHER PUBLICATIONS

U.S. patent application Ser. No. 07/469,250, Johnson, filed Jan. 24, 1990.

Maurer Engineering Report entitled "Deep Earth Sampling System, Phase I, Final Report" Maurer Engineering, Inc. (Jun. 1990).

"M.I.T. Coil Drill–200," Trenchless Technology and Construction, Inc., (undated).

Pipeline & Utilities Construction, "Trenchless Pipelaying Report" (Mar. 1990).

Drawing No. 175S100, "Assy, Steering Rotator Package," Stri–haf–ka & Associates.

* cited by examiner

*Primary Examiner*—David Bagnell
*Assistant Examiner*—Jennifer R Dougherty
(74) *Attorney, Agent, or Firm*—Jenkens & Gilchrist

(57) ABSTRACT

The invention relates to a system for coiled tubing drilling of substantially horizontal shallow depth boreholes for installation of transmission or conveyance lines. A mobile platform mounts a coiled tubing reel and an adjustably mounted injector head. On the leading end of the coiled tubing is a drilling assembly, including a drill, a drill motor, and an orienter. Once the borehole has been drilled by pushing the drilling assembly through the borehole and exiting the earth's surface, a back reamer may be attached for enlarging the borehole as the coiled tubing is pulled back through the borehole. Once the borehole has been properly sized, the transmission or conveyance line may be attached to the leading end of the coiled tubing and the transmission or conveyance pipe pulled back through the borehole.

28 Claims, 4 Drawing Sheets

SHALLOW DEPTH, COILED TUBING HORIZONTAL DRILLING SYSTEM

This application claims the benefit of U.S. provisional patent application No. 60/215,534, filed Jun. 30, 2000, U.S. provisional patent application No. 60/233,358 filed Sep. 18, 2000; and U.S. provisional patent application No. 60,258,119 filed Dec. 22, 2000.

FIELD

The present invention involves horizontal directional drilling systems; more particularly, the present invention involves shallow depth, coiled tubing, horizontal directional drilling systems for the installation of transmission and conveyance lines—to include pipes, tubing, and cable.

BACKGROUND

Over the past fifteen years, methods for installing underground transmission and conveyance lines have advanced from digging trenches to using horizontal directional drilling techniques in some limited applications. The use of horizontal directional drilling techniques involves drilling horizontal boreholes beneath the earth's surface using techniques similar to those perfected in the oil and gas exploration industry for drilling deep wells in a high pressure environment.

Horizontal directional drilling is a method for the trenchless installation of underground pipelines. The purpose for the use of horizontal drilling techniques is to install shallow depth transmission and conveyance systems in a minimal or non-pressure environment. Typically, such transmission and conveyance systems are used with various utilities such as electrical power, communications, natural gas, irrigation, petroleum, potable water, storm drains, and sewer service. Shallow depth horizontal directional drilling is accomplished by first drilling a pilot hole in a relatively horizontal plane, exiting the earth, and pulling the transmission or conveyance line; such as pipe or tubing, back through the pilot hole once it has been properly sized.

The drilling equipment used in shallow depth horizontal direction drilling adapts oil field technology for the purpose of drilling horizontal boreholes through earthen materials versus traditional vertical boreholes used in deep wells. However, unlike vertical well drilling, horizontal directional drilling is not performed under the high pressure conditions typically found in deep wells.

All of the known equipment presently in use for shallow depth horizontal directional drilling is based on the use of a rotating segmented pipe string for drilling the borehole. Specifically, the drilling equipment includes either a piston/chain or rack and pinion drive mechanism which pushes or pulls a motor along a length of track. The length of track is slightly longer than the segment of drill pipe being used. During the borehole drilling process, a segment of pipe is loaded onto the track. The segment of pipe is then attached to the drill motor and the previous pipe segment by rotating the drill motor and threading each coupling, or tool joint, together. Once the segments have been threaded and locked together, the drill motor assembly is then thrust forward while rotating all of the pipe segments, at a slight declining angle. The slight declining angle pushes the drill string (pipe) forward into the ground. Once the drill motor has reached the end of the track, the pipe is clamped and the drill motor is counter-rotated to enable disengagement of the drill motor from the drill string. The drill motor is then retracted (pulled back) and another segment of pipe is loaded on the track. This process is continued—pipe segment by pipe segment—throughout the entire length of the horizontal borehole that is to be produced.

During the boring (drilling) process the drill motor continually rotates. Accordingly, the entire drill string, including all of the pipe segments, is rotated. The motor is stopped only during times when it is necessary to change the direction of the drillstring through the ground, and add or remove drill pipe segments.

The actual downhole bend or turn of all of the drill pipe segments in the drill string, is accomplished using a bent housing assembly. The bent housing assembly enables the operator to push the drill string to follow the angle of the bent housing assembly. Once the turn of the drill string is completed, the operator engages the drill motor and the drill string is pushed forward while continuing to spin the entire drill string.

Once the initial borehole, or "pilot hole," has been completed, the borehole is typically back reamed. In back reaming, the drilling process is effectively reversed by attaching a larger bit to the drill string and reaming a larger hole while pulling the string back towards the drilling equipment, one pipe segment at a time.

Once the borehole has been back reamed, the drill string is reinserted into the borehole and run to the end. The pipeline to be installed is attached at the exit hole and then pulled into the borehole by the drilling equipment. As with pushing the drill string into the hole, when pulling the drill string, each segment of pipe in the drill string is pulled back—one by one—through the borehole, and detached from the next segment by the drill motor, and subsequently put aside. The drill motor then locks onto the next segment of pipe and pulls the drill string back through the borehole. This segment by segment process continues until the new pipe is fully placed into the ground. All of this work is done without trenching.

The horizontal directional drilling practices described above are parallel to the drilling methods performed in the oil and gas industry. However, today many petroleum contractors are utilizing coiled tubing as a more efficient and diversified means of drilling vertical boreholes for the production of hydrocarbons from deep wells.

The technology of coiled tubing drilling has been used for approximately 30 years. During the past 7–10 years there has been a dramatic increase in the use and applications of coiled tubing in the petroleum sector for use in deep wells. In coiled tubing well drilling, a continuous line of flexible steel pipe is used. The coiled tubing tube is stored on a reel. The primary advantage of using coiled tubing for deep well drilling is the efficiency that is gained from the absence of segmented pipe joints that must be threadably connected, disconnected, and re-connected one from another. In such applications, the leading end of the coiled tubing never exits the earth's surface.

Historically, segments of drilling pipe were used for drilling and conducting operations inside an oil or gas well, usually several hundreds or thousands of feet under the surface. Each segment of pipe was required to be positioned and attached to the previous pipe segment and then lowered or drilled into the ground. This drilling process, although still highly utilized, is at times laborious and time consuming. With the advent of coiled tubing drilling techniques, drilling contractors were able to supply more efficient and reliable methods of performing many downhole operations in deep wells. With the use of injector heads designed specifically for guiding coiled tubing into a substantially vertical borehole, and various other technologies, operators gained the capacity to continuously feed equipment and fluids into both existing wells and newly drilled wells. When working in deep wells under pressure, the coiled tubing must be able to not only withstand tensile and flexural stresses associated with the drilling process; but also, the internal and external pressures experienced downhole in deep wells.

Many of the same drilling techniques that are utilized when drilling with segmented pipe are also carried out with coiled tubing, but there are clear differences. In a typical coiled tubing well drilling application, the injector head is mounted or suspended in a vertical position above the existing well to be worked over or drilled. The coiled tubing is then guided off a storage reel and over a gooseneck. This gooseneck is utilized to position the coiled tubing for direct insertion into the injector head. The injector head controls the insertion and removal of the coiled tubing from the well. A gooseneck is necessary to provide a means for maximizing the bending radius that the tubing must endure when making the transition from being substantially parallel to the ground, as it leaves the reel, to becoming perpendicular to the ground as it is "stabbed" into the injector head and injected substantially vertically down into the well. The coiled tubing drill string is injected or pushed some specific depth into an oil or gas well and the work-over or well drilling operation is performed. Once the drilling of the well is complete, the coiled tubing is retracted, pulled out of the well, and accumulated back onto the storage reel.

Experience in drilling oil and gas wells has shown that coiled tubing typically has a shorter life cycle than straight segmented pipe. This shorter life cycle is due to the bending that coiled tubing must endure as it is reeled on and off the reel and run over the gooseneck. The more bends the coiled tubing is put through, the more fatigued and brittle the coiled tubing becomes, and in turn reduces the number of production cycles available to the user.

Coiled tubing had been predominantly utilized to clean out existing oil and gas wells. However, with advancements in new drilling technologies, the use of coiled tubing has been expanded to well operations such as re-entry and horizontal deviations (kick-offs). Recently, coiled tubing utilization has been expanded into shallow vertical gas well drilling operations by the use of downhole drilling motors. Modern coiled tubing drilling operations are used to drill substantially vertical slim hole wells (wells of smaller than normal diameter), deploy reeled completions, log high angle boreholes, and deploy treatment fluids downhole. The use of coiled tubing in deep directional wells or even in deep horizontal wells (i.e., wells that begin as vertical and then deviate to horizontal) continues to increase at a rapid rate.

The need remains, however, to adapt the coiled tubing drilling techniques used in oil and gas well drilling to shallow depth horizontal drilling for the installation of transmission and conveyance lines.

SUMMARY

The present invention includes a system, a method, and an apparatus for utilizing coiled tubing drilling techniques to bore shallow depth, substantially horizontal, boreholes for the installation of transmission and conveyance lines.

The disclosed system, method, and apparatus includes a staging reel from which the coiled tubing is wound and unwound. After exiting the staging reel, the coiled tubing enters a tubing guide system which guides the tubing between the storage reel and the injector head and minimizes the bend radius of unsupported tubing. Controlling the insertion of the coiled tubing in the ground is a coiled tubing injector head. The coiled tubing injector head is adjustably mounted to guide the coiled tubing into the earth at an acute angle. The result is a shallow depth borehole substantially parallel to the earth's surface. Attached to the leading end of the coiled tubing is a drill motor. Conventional techniques are used to locate and guide the coiled tubing and the drill motor as they pass substantially horizontally through the earth at shallow depths beneath the earth's surface. The leading end of the coiled tubing exits the earth's surface. The completed borehole may then be back reamed to enlarge its diameter. Transmission and conveyance lines may follow the back reamer or may be installed after the back reaming operation has been completed. Alternatively, the coiled tubing may be left in the earth to act as a transmission or conveyance line.

BRIEF DESCRIPTION OF THE DRAWING FIGURES

A better understanding of the system, method, and apparatus of the present invention may be had by reference to the drawing figures, wherein.

DESCRIPTION OF THE EMBODIMENTS

In the preferred embodiment 10, the leading end 102 of the coiled tubing 100 or the end which enters the borehole is fitted with the necessary connectors to enable the attachment of a variety of different tools and fittings, commonly referred to as downhole tools. Such connectors are well known to those of ordinary skill in the art.

The downhole tools used with the coiled tubing include, but are not limited to, tracking sensors, orienters, drilling motors, and drill bits. The combination of these downhole tools with a drill bit at the leading end 102 of the coiled tubing 100 becomes the drilling assembly which bores through the earthen environment encountered at the leading end 102 of the coiled tubing 100.

Figure 3:
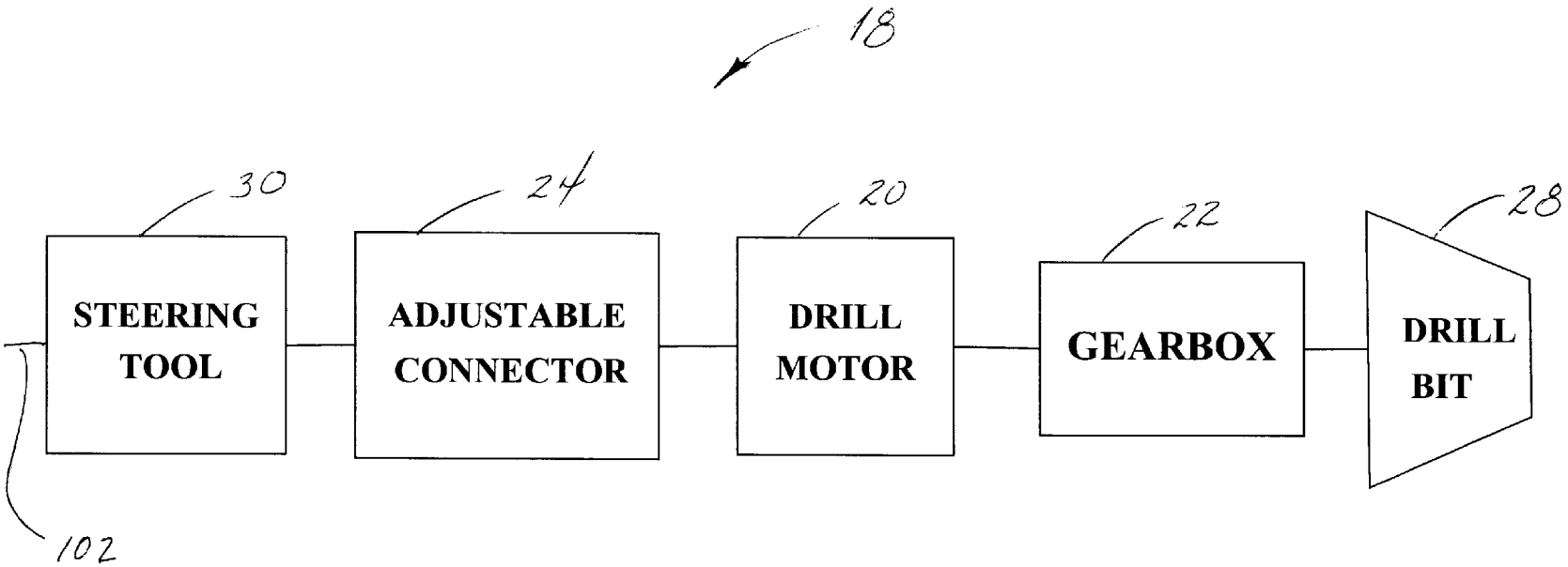
FIG. 3 is a schematic diagram of the components of a drilling assembly used for drilling a pilot hole.
Figure 4:
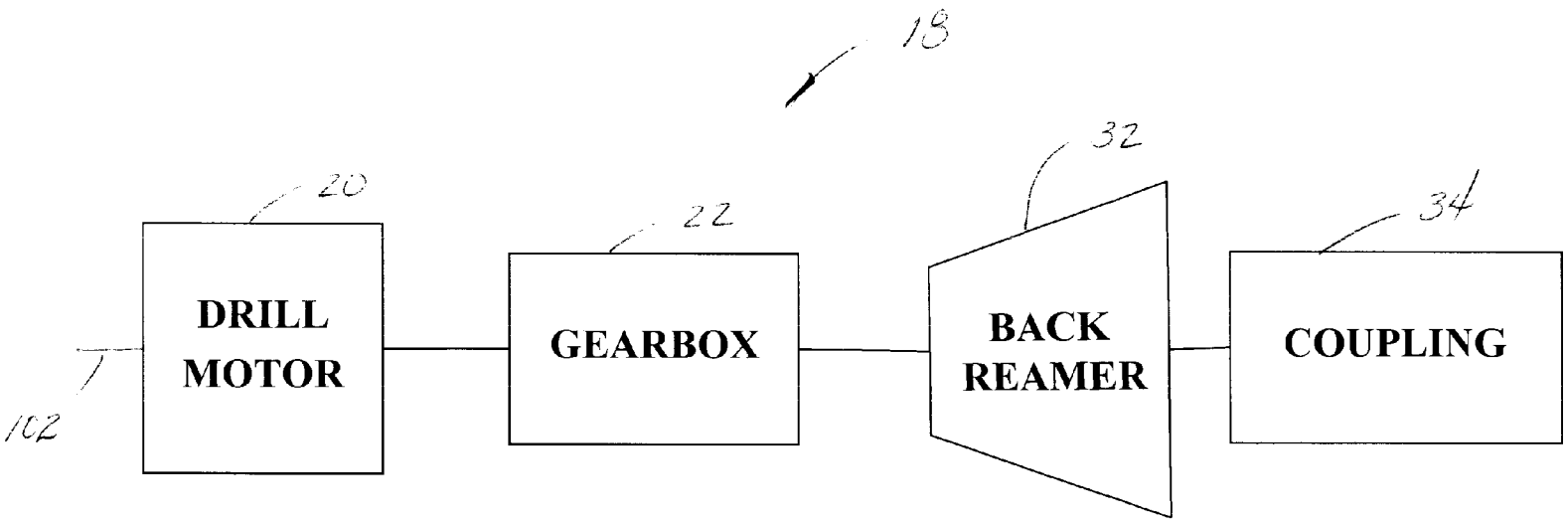
FIG. 4 is a schematic diagram of the components of a drilling assembly used for back reaming or enlarging a pilot hole.

In the preferred embodiment 10, the drilling assembly 18 shown in FIG. 3 includes an electric motor 20. Power to the electric motor 20 is transmitted by wires placed within the internal diameter of the coiled tubing 100. The electric motor 20 may be of sufficient power to supply the necessary torque for drilling, or the drilling assembly may include a gearbox, speed reducer, or torque converter 22 for the purpose of amplifying the torque supplied by the motor 20 when hard soils or rocky conditions are encountered. In an alternate embodiment, a hydraulic, pneumatic, or fluid driven motor may be used.

Drilling mud is either pumped through the electric motor or around the electric motor, depending on the type of drill motor used. The drilling mud is then projected through the drill bit 28 for the purpose of cooling the drill bit 28 and washing away cutting debris from the cutting faces on the drill bit.

As the coiled tubing 100 is pushed into the earth's surface E and progresses forward along the desired horizontal path, the motor 20 at the leading end 102 of the coiled tubing 100 provides the necessary rotational torque to permit the drill bit to cut a borehole through the earth. At some point during the drilling operation, it becomes necessary to orient the motor 20 to address the need to assure that the path of the borehole follows along a desired route. This is particularly critical when the transmission or conveyance lines are installed for utilities, as easements for utilities are sometimes quite narrow and tightly defined.

Adjustment of the path traveled by the drill motor 20 may be accomplished by the use of a remotely operated adjustable connection 24 located at the leading end 102 of the coiled tubing 100. The remotely operated adjustable connection 24 is set with the desired bend or angle which enables controlling the drilling direction to relatively any point within a 360° circle. This positioning of the drill motor 20 occurs not by rotating from one point to another, but rather by adjusting the angle on the remotely operated adjustable connection 24.

At the beginning of the drilling operation, the remotely operated adjustable connection 24 begins in a position that does not include a bend; however, upon command from controls located at the surface, the remotely operated adjustable connection may be reconfigured to the desired degree of bend and the circumferential position in one single motion. On the receipt of the second command, the remotely operated adjustable connection 24 may either return to a straight position or may move directly to a next angular position. As previously indicated, the remotely operated adjustable connection 24 begins with a 0° bend. Upon command from the driller's console 26, the remotely operated adjustable connection 24 moves, for example, to a 2° bend and points in another direction. Upon the receipt of yet another command, the remotely operated adjustable connection 24 may readjust and move directly to yet another bend that points in a different direction or any other desired point, as commanded from the driller's console 26. This bendability of the remotely operated adjustable connection 24 enables constant controllable steering of the drill motor 20 through the borehole.

The tracking of the underground position of the drill motor 20 and drill bit 28 is a well known technique utilizing either beacon communication signals from a steering tool 30 that are received at the surface or signals that are transmitted via a wire line placed in the inside diameter of the coiled tubing 100. Such downhole positioning techniques are well understood by those of ordinary skill in the art. In the preferred embodiment, the use of a wire line through the coiled tubing 100 is preferred because of the location accuracy it provides.

During the entire drilling process, there is never the need to stop the drilling operation to add continuous pieces of tubing. Once the continuous length of coiled tubing 100 is inserted into the earth, a continually operational drilling process occurs. This continually operational drilling process follows a predetermined underground shallow depth path until the borehole is complete. Near the predetermined end of the borehole, the orientation of the drilling assembly 18 is caused to project upwardly. Such upward projection causes the drill bit 28 to exit the earth. Upon the exiting of the earth by the drill bit 28, the drilled pilot hole becomes complete. The drilled pilot hole may then be enlarged, as described below or lined with a conveyance or transmission line or both.

Figure 1:
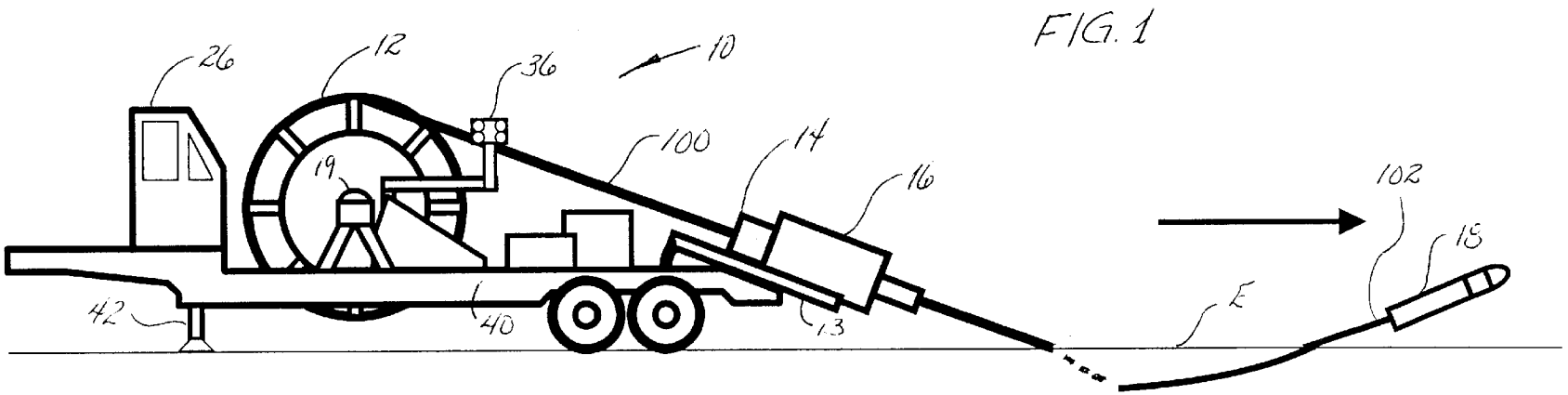
FIG. 1 is a side elevational view of the horizontal directional drilling system of the present invention mounted on a towed wheeled trailer.
Figure 2:
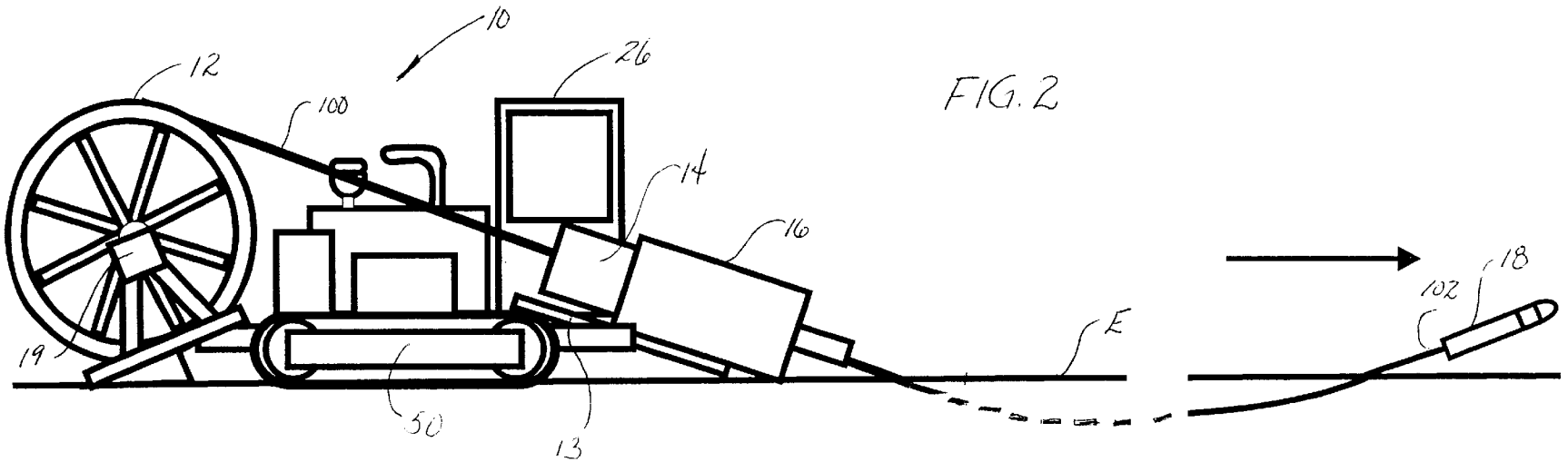
FIG. 2 is a side elevational view of the horizontal directional drilling system mounted on a self propelled tracked platform.

Alternatively, the drilling operation may be done pit to pit. In this alternate method of drilling a pilot hole, a portion of the drilling system 10, such as the injector head 16 which has been removed from the vehicles shown in either FIG. 1 or FIG. 2, is placed in a pre-dug entry pit. The tubing injector head 16 then directs the coiled tubing 100 into the soil wall at the end of the entry pit. At the distal end of the desired underground travel path for the coiled tubing 100, a pre-dug exit pit may be used. When the hole is complete, the drilling assembly at the leading end of the coiled tubing 100 breaks through the wall at the end of the exit pit.

Once the drilling of the pilot hole is complete and the leading end 102 of the coiled tubing 100, with downhole tools attached, exits through the earth's surface E, the process of back reaming may begin if the need exists to enlarge the diameter of the borehole.

At the beginning of the back reaming operation, the operator may remove the steering tool or tracking device 30 and the remotely operated adjustable connection 24. An oversized bit, typically called a back reamer 32, is then attached to the drill motor 20. Back reamers 32 are oversized drill bits with the cutting face directed toward the drilling unit so that the back reamer may cut the pilot hole open to a larger diameter while being pulled back through the borehole by the coiled tubing 100 already in the pilot hole. If desired, the back reamer 32 may include an internal mechanism such as a gearbox to amplify the output torque of the drill motor 20.

Once a back reamer is attached to the end of the coiled tubing drill string, the coiled tubing drill string 100 is then pulled back through the hole using the injector head 16. The injector head 16 still remains located at the point of entry of the coiled tubing drill string 100 into the ground. Providing power to the drill motor 20 at the leading end of the coiled tubing 100 enables the back reamer 32 to begin rotation. As the back reamer 32 creates a larger hole as it passes through the pilot hole, drilling mud may still be pumped through the pilot hole. Drilling mud is supplied through the coiled tubing 100 to clean out the enlarged borehole. If necessary, the pilot hole may be enlarged in steps. This is accomplished by pulling the back reamer 32 into the entry pit and then pushed back through the borehole to the exit pit with the next size larger reamer attached. A further advancement of the disclosed mechanized reamer is that it may be capable of expanding to variable hole diameters on one particular unit. The back reamer 32 unit is either adjustable or modular, depending on its type and design. Once the final diameter reamer is attached, a further coupling 34 may be attached. This last coupling 34 is utilized to attach the transmission or conveyance line that is to be installed. The transmission or conveyance line is pulled behind the back reamer 32 with the pulling energy being supplied by the injector head 16 itself at the entrance to the borehole. The transmission or conveyance line can be made from various types of material, including but not limited to PVC, HDPE, steel, fiberglass.

The coiled tubing drill string 100 is then pulled completely back through the borehole, including the motor 20, the back reamer 32, and the conduit, and is wound back on the reel storage assembly 12. Once the drilling motor 20 and back reamer 32 reach the entry pit or entry into the earth's surface E, the transmission or conveyance line is disconnected from the coupling 34 and the back reamer assembly 32. The transmission or conveyance line may be left in the ground for the purpose designated by the customer; typically, a transmission or conveyance pipe used for a utility service.

The motor 20, the back reamer 32, the adjustable coupling 34, and all downhole tools on the leading end of the coiled tubing 100 are then removed and prepared for use at the next borehole. Typically, the coiled tubing 100 will stay inserted in the injector head 16 as an effective means of transport of all the equipment and relocation of the present invention to the next jobsite.

In some applications, drilling operators may prefer to use conventional mud motor technology, which is typically found in the oil and gas industry and common horizontal drilling operations. When mud motors are used, the manner in which orientation may be accomplished as described by U.S. Pat. No. 5,485,889 and those other well techniques well known to those of ordinary skill in the art. The back reaming process can be carried out using the mud motor or by attaching an electric motor 20 if desired to be used in conjunction with a mechanized back reamer 32.

It is also possible to utilize hydraulic or pneumatic motors as a drill motor. Power is supplied by hydraulic or pressurized gas lines placed within the coiled tubing.

Another possible variation of the present invention is the use of percussion hammers. Such percussion hammers are driven, either by drilling mud or pneumatics. Percussion hammers are utilized with an angled bit face and would be rotated as previously mentioned to drill straight and would be positioned through the use of the electric motor. The percussion tool would then be removed to facilitate back reaming, which would then be driven by an electric motor or another mechanized alternative power source.

Still another possible variation of the present invention is the use of a jetting tool of the leading end 102 of the coiled tubing 100. Jetting tools which utilize high pressure water streams to cut through earthen materials are often more effective in softer soils than conventional drill bits. Jetting tools may be used for either boring the pilot hole or back reaming.

As shown in FIG. 1, the unit may be mounted on a towed wheeled trailer system 40; or as shown in FIG. 2, the unit may be mounted on a self-propelled tracked platform 50. The key features, as disclosed in both FIG. 1 and in FIG. 2, are:

A staging reel assembly 12 utilized for spooling and unspooling the coiled tubing 100. The staging reel assembly 12 may be mounted to swivel on a horizontal axis or may be adjustably mounted 13 to be vertically raised and lowered as needed.

A drive mechanism which projects the tubing 100 forward and eventually pulls it backward. The drive mechanism is commonly referred to as a tubing injector head 16.

An apparatus for the purpose of assisting the operation during which the coiled tubing 100 is wound or unwound from the staging reel 12 may be included. This apparatus is typically referred to as a level winder 36. The level winder 36 may be either part of the staging reel assembly 12 or mounted separately on the transport vehicle 40, 50.

The injector head 16 may be supported by an adjustable mounting 19 which allows positioning of the injector head 16 at an acute angle with respect to the earth's surface and moved closer to the entry point of the leading end of the coiled tubing 100 to the earth's surface.

A guide 14 conveys the tubing 100 from the staging reel assembly 12 and inserts the leading end of the coiled tubing centrally into the injector head 16.

A triplex pump which is utilized for pumping drilling muds through the tubing.

An engine which provides the necessary power to operate the complete unit.

An operator station or driller's console 26 to allow the operator to perform all necessary functions required to accomplish the drilling operation.

Support devices for stabilizing the equipment and, if necessary, making angle adjustments. This equipment is also referred to as an outrigger 42.

In operation, the system of the present invention 100 is transported to the jobsite. The trailer 40 shown in FIG. 1 is towed. The tracked vehicle 50 shown in FIG. 2 may be transported on a flat bed trailer, then moved into position by utilizing the tracks after arrival at the jobsite. If the unit shown in FIG. 1 is used, then the unit may either be operated from the wheeled trailer 40 or components may be skid mounted to assist in removal and placement.

Once the system of the present invention is off-loaded, it is positioned to target a desired drilling path. The outriggers 42 on the system may be positioned and extended to stabilize the system. The injector head 16, which is mounted on an adjustable support 19 at an acute angle, is then placed into position at the desired drilling angle and as close to the ground as possible. The drilling angle is typically not less than 10° or no greater than 45° from horizontal. The operator's console 26 on either the wheeled platform 40 or the self-propelled tracked platform 50 may be adjusted to provide the operator with the greatest amount of visibility to perform all necessary drilling operations.

Typically the coiled tubing 100 is guided into and inserted into the injector head 16 before arrival at the jobsite. But if the coiled tubing 100 is not inserted into the injector head 16, a stabbing operation is required. Once the coiled tubing 100 is inside the injector head 16 and has begun to exit at the opposite end of the injector head 16, the necessary downhole tools are attached to the leading end of the coiled tubing 100. As previously indicated, a variety of tools may be attached to the leading end of the coiled tubing 100. Such downhole tools may include one or more of the following:

A drill bit tool 28 that is capable of cutting through geological conditions. The drill bit 28 itself is attached to a drill motor 20 which may be operated by pressurized fluid, pressurized air, or by electrical current. This motor is typically called the downhole motor.

A navigational tool 30 which provides horizontal inclination (i.e., up and down based on a horizontal plane), horizontal deviation, (i.e., left and right), and clock face orientation of the vertical position. This tool 30 is commonly referred to as the steering tool.

A remotely operated adjustable connection 24 or positioning device which permits the directional change of the downhole motor 20 operated from the surface. The positioning device 24 is typically operated based on readings taken from the steering tool 30 commonly referred to as the orienter.

Once all downhole tools required for the specific drilling operation are attached to the leading end 102 of the coiled tubing drill string 100, the drilling operation is started. The operator begins the drilling operation by activating the downhole motor 20. The activation of the downhole motor 20 in turn rotates the drill bit 28. The coiled tubing 100 does not rotate. Once the downhole motor 20 has been engaged, the injector head 16 begins driving the leading end 102 of the coiled tubing 100 forward. The angle at which the coiled tubing 100 enters the ground is chosen so that the downhole tools and the coiled tubing 100 are allowed to move along a shallow depth, horizontal path as soon as practicable. In the preferred embodiment, it has been shown that the horizontal path ranges from, but is not limited to, 6 feet to 50 feet depending on the jobsite. As the coiled tubing drill string 100 is pushed into the ground by the injector head 16, the downhole motor 20 continuously causes the drill bit 28 to cut into the earth. The cuttings may be returned by use of the drilling fluid. During the drilling operation, the borehole is continuously monitored by communication signals received from the steering tool 30. These communication signals are transmitted and received either by a wire line signal or some form of radio or beacon signal. The operator then makes the necessary corrections in direction by redirecting the orienter 24. This drilling operation continues along the shallow depth, horizontal path until the desired exit point from the borehole is reached. At this point the operator then positions the orienter in such a manner so that the drill bit 28 and the other downhole tools return to the earth's surface and actually exit the ground. This completes the drilling of the pilot hole.

Once the pilot hole has been completely drilled, the downhole tools are removed. Typically, all that is left on the leading end of the coiled tubing 100 is the downhole motor 20. The orienter 24 is not generally needed and the steering tool 30 is also generally not needed unless it is necessary to track the back reaming operation. At this point, a back reaming bit 32 is then attached to the downhole motor 20. This back reamer bit 32 is typically oversized and designed to enlarge the hole during the pullback operation to expand the hole to a diameter which will allow the installation of whatever size or type of transmission or conveyance line is desired. In some cases it may be necessary to enlarge the borehole in multiple stages. In this scenario, one back reaming operation occurs and then the back reamer 32 is put back through the enlarged hole and the next size back reamer is placed on the end of the coiled tubing drill string. Once the final size reamer has been applied to the leading edge of the tubing for enlarging the hole, the tubing product is typically attached behind the back reamer through the use of a coupling 34. The operator then engages the injector head 16 to pull back the coiled tubing 100 through the pilot hole and activates the downhole motor 20 so as rotate the back reamer 32. The back reamer 32 begins to cut the hole to the desired diameter, and the pipe to be installed is pulled behind the back reamer 32. The entire string (coiled tubing, downhole motor, reamer, coupling, transmission or conveyance line) are then pulled back through the hole. If desired, the coiled tubing 100 used to push the drilling assembly 18 through the borehole may become the transmission or conveyance line by removing the drilling assembly 18 from the leading end of the coiled tubing 100 and leaving the coiled tubing 100 in the borehole.

When the drilling is complete, all downhole tools are removed from the coiled tubing 100 and set aside. The coiled tubing 100 itself is then checked for integrity and prepared for final connections. This completes the description of the drilling of the bore hole and the installation of the transmission or conveyance line.

In an alternative application, the apparatus, method, and system of the present invention may be used for enlarging existing underground transmission or conveyance lines where it is possible to place an enlarger or pipe bursting tool onto the leading end of the coiled tubing once the coiled tubing has passed through the existing transmission or conveyance line. Specifically, the coiled tubing is pushed through an existing transmission or conveyance line by the tubing injector head. Once the leading end of the coiled tubing exits the existing transmission or conveyance line and becomes accessible, a pipe bursting tool, a reaming tool, or other similar tools known by those or ordinary skill in the art may be attached to the leading end of the coiled tubing and pulled back through the existing transmission or conveyance line. If desired, a new transmission or conveyance line may be pulled behind the pipe bursting or back reaming tool. Or, the existing transmission or conveyance line may be removed before a new transmission or conveyance line is installed.

In yet still another alternative application, the system, method and apparatus of the present invention may be used to temporarily place cables at a shallow depth, under an object to be lifted from the earth's surface. In such applications, a pilot hole is first drilled under the object to be lifted and the lifting cable is then drawn back through the pilot hole.

While the system, apparatus, and method have been described according to the preferred and alternate embodiments, those of ordinary skill in the art will understand that numerous other embodiments of the disclosed invention may be made. Such other embodiments shall be included within the scope and meaning of the appended claims.

What is claimed is:

1. A coiled tubing drilling and reaming apparatus for creating substantially horizontal, shallow depth boreholes beneath the earth's surface and for the installation of for transmission or conveyance lines, said apparatus comprising:

a mobile platform;

a staging reel mounted on a first end of said mobile platform, said staging reel constructed and arranged for storage, spooling and unspooling of the coiled tubing;

a coiled tubing injector head for exerting both push and pull forces on the coiled tubing and for injecting the coiled tubing through the earth's surface into the earth and moving the coiled tubing through the shallow depth borehole;

means for guiding the coiled tubing from said staging reel to the coiled tubing injector head;

means for adjustably mounting said coiled tubing injector head at an acute angle with respect to the earth's surface;

means for drilling a borehole through the earth while push forces are being exerted on the coiled tubing, said means for drilling a borehole being mounted on the end of the coiled tubing entering the borehole;

means for orienting said means for drilling a borehole and causing said means for drilling to exit the shallow depth bore hole through the earth's surface, said means for orienting said means for drilling a borehole being co-located with said means for drilling; and means for back reaming the borehole to a diameter which allows for the pulling of the transmission or conveyance line therethrough when pull forces are being exerted on the coiled tubing.

2. The coiled tubing drilling and reaming apparatus of claim 1 wherein said coiled tubing injector head is mounted on a second end of said mobile platform.

3. The coiled tubing drilling and reaming apparatus of claim 1 wherein said mobile platform is wheeled.

4. The coiled tubing drilling and reaming apparatus of claim 1 wherein said mobile platform is a self-propelled tracked vehicle.

5. The coiled tubing drilling and reaming apparatus as defined in claim 1 wherein said staging reel swivels on a horizontal axis.

6. The coiled tubing drilling and reaming apparatus as defined in claim 1 wherein said staging reel is mounted to be vertically adjustable.

7. The coiled tubing drilling and reaming apparatus as defined in claim 1 wherein said means for drilling and said means for back reaming includes a fluid motor and wherein fluid is supplied to said fluid motor under pressure through the coiled tubing.

8. The coiled tubing drilling and reaming apparatus as defined in claim 1 wherein said means for drilling and said means for back reaming includes an electric motor.

9. The coiled tubing drilling and reaming apparatus as defined in claim 1 wherein the coiled tubing includes an electrical conduit for controlling the operation of motor or communication signals.

10. The coiled tubing drilling and reaming apparatus as defined in claim 1 wherein said means for drilling includes a drill bit, a drill motor and a gearbox.

11. The coiled tubing drilling and reaming apparatus as defined in claim 1 wherein said means for orienting includes means for remotely changing the angular orientation of said means for drilling with respect to the long axis of said borehole.

12. The coiled tubing drilling and reaming apparatus as defined in claim 1 wherein control of said spooling and unspooling of the coiled tubing from said staging reel is assisted by a level winder.

13. The coiled tubing drilling and reaming apparatus as defined in claim 1 wherein said means for orienting is remotely controlled from above the earth's surface.

14. A method for using coiled tubing to drill and backream a substantially horizontal shallow depth borehole through the earth for the placement of transmission or conveyance lines, said method comprising the steps of:

storing a length of coiled tubing on a storage reel;

unwinding the coiled tubing from said storage reel;

guiding one end of said length of coiled tubing from said storage reel to a coiled tubing injector head;

guiding the free end of said coiled tubing through said coiled tubing injector head;

attaching a guide tool to the free end of said coiled tubing;

attaching a drill bit and drill motor to said guide tool;

inserting said drill bit and drill motor into the earth through the earth's surface at an acute angle;

causing said drill bit and drill motor, said guide tool and the coiled tubing to be pushed through the earth in a first direction by said coiled tubing injector head to create a substantially horizontal shallow depth borehole;

causing said drill bit and drill motor to exit the earth through the earth's surface;

causing an attached back reamer, said drill and drill motor, said guide tool and the coiled tubing to be pulled through the earth in a second direction, opposite to said first direction, by said coiled tubing injector head to enlarge the substantially horizontal shallow depth borehole.

15. The method as defined in claim 14 wherein said drill bit is caused to penetrate the earth's surface from an entry pit.

16. The method as defined in claim 14 wherein the unwinding of the coiled tubing from the storage reel is assisted by a level winder.

17. The method as defined in claim 14 wherein the angle of insertion of said drill bit and drill motor through the earth's surface is controlled by the angular position of said coiled tubing injector head.

18. The method as defined in claim 14 wherein said adjustable guide tool is remotely controlled from a position above the earth's surface.

19. The method as defined in claim 14 wherein said storage reel and said coiled tubing insertion tool are mounted on separate platforms.

20. The method as defined in claim 14 wherein said drill bit and drill motor are caused to enter an exit pit following the drilling of the borehole in said first direction.

21. The method as defined in claim 14 wherein said borehole is backreamed with an enlarged bit following the pushing of the coiled tubing in a first direction and while the coiled tubing is being pulled in a second direction.

22. The method as defined in claim 14 wherein a transmission or conveyance line is pulled in said second direction through the borehole.

23. The method as defined in claim 14 wherein the coiled tubing is left in the borehole to become a transmission or conveyance line.

24. A system for creating a substantially horizontal shallow depth borehole lined by a transmission or conveyance line through the earth, said system comprising:

a coiled tubing drill string having a leading end;

a reel assembly for winding, storing, and unwinding said coiled tubing drill string;

a drilling assembly mounted to the leading end of said coiled tubing drill string, said drilling assembly including an orienter, a drill motor, a drill bit, and a steering tool;

an injector head for guiding said coiled tubing drill string into the borehole at an acute angle to the earth's surface, for pushing said coiled tubing through the earth and to exit the earth's surface for pulling said coiled tubing from the borehole, and for lining the borehole with a transmission or conveyance line;

a connector for connecting said transmission or conveyance pipe to the leading end of the coiled tubing drill string to enable the transmission or conveyance pipe to be drawn into the borehole as said coiled tubing is pulled from the borehole.

25. The system as defined in claim 24 wherein said reel and said injector head are mounted on a mobile platform.

26. The system as defined in claim 25 wherein said mobile platform is a wheeled trailer.

27. The system as defined in claim 25 wherein said mobile platform is a tracked vehicle.

28. The system as defined in claim 25 wherein said drill bit is replaced with an enlarging back reamer when said transmission or conveyance line is pulled back through the borehole.

* * * * *